United States Patent [19]

Maggiorana

[11] 4,220,121

[45] Sep. 2, 1980

[54] HEAT EXCHANGER FOR MARINE PROPULSION ENGINES

[75] Inventor: Mario A. Maggiorana, Highland Park, Ill.

[73] Assignee: Brunswick Corporation, Skokie, Ill.

[21] Appl. No.: 893,258

[22] Filed: Apr. 5, 1978

[51] Int. Cl.[2] ..... F01P 7/16; F28B 9/10

[52] U.S. Cl. ..... 123/41.8; 123/41.08; 165/114; 55/191; 165/DIG. 24

[58] Field of Search ..... 123/41.08, 41.48, 41.54, 123/41.8; 165/159, 161, DIG. 24, 111, 114; 55/191, 177, 203

[56] References Cited

U.S. PATENT DOCUMENTS

| | | | |
|---|---|---|---|
| 1,840,940 | 1/1932 | Ecabert | 165/161 |
| 2,147,993 | 2/1939 | Scheibe | 123/41.54 |
| 2,200,620 | 5/1940 | Findley | 55/191 |
| 2,231,501 | 2/1941 | Jepertinger | 55/191 |
| 3,028,716 | 4/1962 | Sanderson et al. | 123/41.54 |
| 3,201,919 | 8/1965 | Long | 55/191 |
| 3,875,759 | 4/1975 | Malcosky et al. | 165/161 |
| 3,921,708 | 11/1975 | Brenner | 165/159 |

FOREIGN PATENT DOCUMENTS

| | | | |
|---|---|---|---|
| 1048927 | 9/1955 | Fed. Rep. of Germany | 165/159 |
| 2062381 | 6/1972 | Fed. Rep. of Germany | 123/41.54 |
| 2236954 | 2/1973 | Fed. Rep. of Germany | 165/159 |
| 231567 | 3/1969 | U.S.S.R. | 165/111 |

*Primary Examiner*—P. S. Lall

*Attorney, Agent, or Firm*—Wm. G. Lawler, Jr.; Lewis L. Lloyd

[57] ABSTRACT

A heat exchanger is provided for a pressurized, closed cooling system for a marine propulsion engine. The heat exchanger includes a closed spiral passageway means for the fresh cooling water drawn from the lake or other water body. An outer housing encloses the spiral passageway and includes baffle means for directing of a coolant in a spiral path over the cooling passageway means within the housing. The coolant is thereby cooled by the circulating cold fresh water. An air discharge passageway means is provided in the center of the spiral path. The centrifugal forces associated with the spiral flow of the cooling coolant results in the water moving outwardly within the passageway while the air tends to collect within the center thereof where it is collected and discharged by the air passageway means for automatic separation and removal of the air.

13 Claims, 11 Drawing Figures

HEAT EXCHANGER FOR MARINE PROPULSION ENGINES

BACKGROUND OF THE INVENTION

This invention relates to a heat exhanger for a pressurized, closed loop cooling system for an internal combustion engine.

Inboard mounted marine propulsion engines may advantageously be provided with a closed cooling system. The system includes a closed recirculating water loop which circulates coolant through the engine block and coupled to a separate cooling loop through a heat exchanger. The separate cooling loop draws fresh water from the body of water and passes it through the heat exchanger and then back to the body of water. The closed loop system provides maximum protection of the engine from the corrosive effect of the fresh cooling water.

In such systems it is, of course, important to maintain minimal resistance to flow for maximum transfer of thermal energy or cooling of the closed loop coolant. Another significant factor encountered in such closed loop systems is the amount of gases introduced into the coolant passed through the engine. Entrained gases in the coolant minimizes its cooling effect and promotes corrosion and erosion.

SUMMARY OF THE PRESENT INVENTION

The present invention is particularly directed to a closed loop cooling system providing a highly efficient flow path and providing automatic means for eliminating of gases from within the coolant.

Generally, in accordance with the present invention, a closed spiral passageway means is provided for the fresh cooling water. An outer housing encloses the spiral passageway means and includes flow directing means for directing of the coolant in a spiral path over the cooling passageway means within the housing.

Gas discharge passageway means is provided in the center of the baffle means. The centrifugal forces associated with the spiral flow of the cooling coolant results in the water moving outwardly within the passageway, while the gas (air) is forced to the axis of the spiral path where it is collected and discharged by the gas passageway means. This provides automatic separation of the gas from the coolant providing maximum thermal efficiency. The spiral flow also provides an efficiency flow path without the restrictive passageway presented by prior art parallel tube units.

The present invention thus provides an improved closed cooling system for marine propulsion engines and the like.

DESCRIPTION OF THE ILLUSTRATED EMBODIMENT

Figure 1:
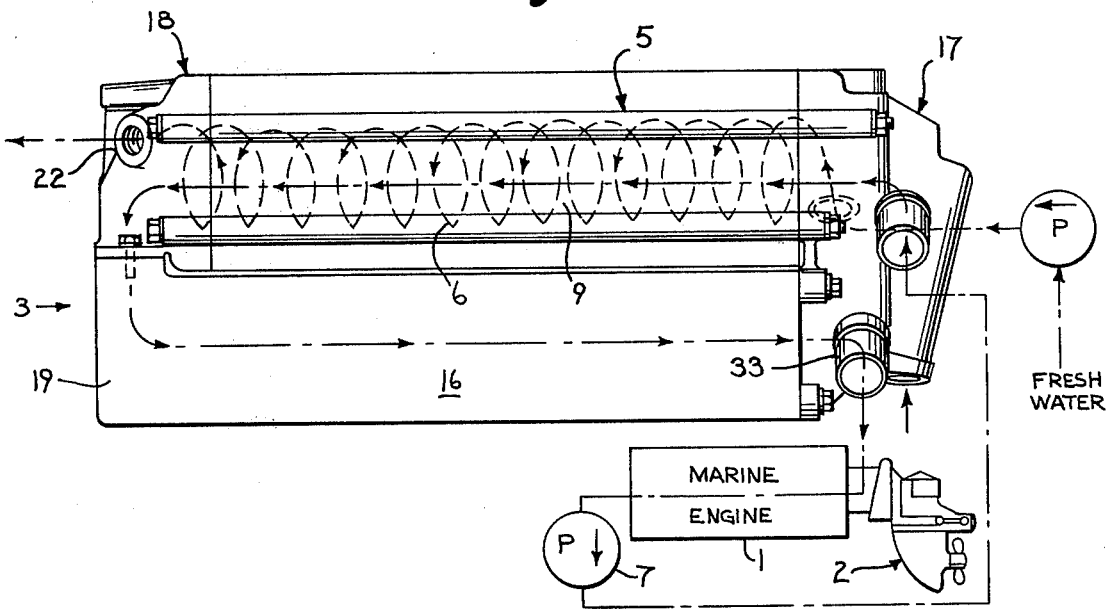
FIG. 1 is an elevational view of the heat exchanger constructed in accordance with the present invention and diagrammatically illustrated applied to a marine propulsion engine.
Figure 3:
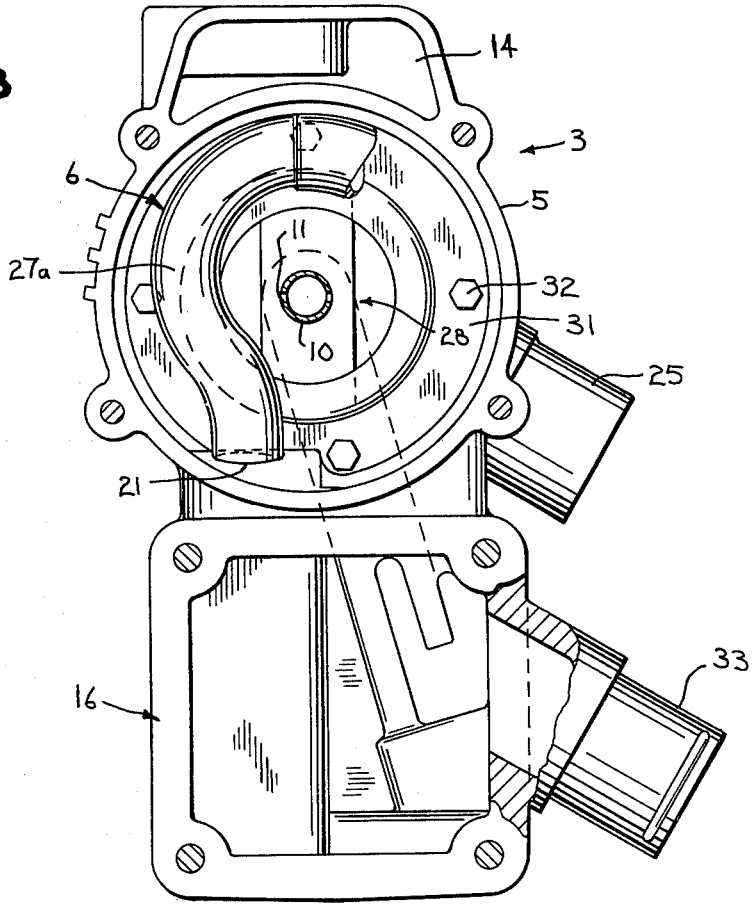
FIG. 3 is a view taken generally on line 3—3 of FIG. 2.

Referring to the drawings and particularly to FIG. 1, a marine propulsion system is diagrammatically illustrated including a marine engine 1 coupled to drive a stern drive unit 2. The system is adapted to be mounted within a boat, not shown, with the engine inboard of the boat and the stern drive unit secured to the transom and depending into the water body. The internal combustion engine 1 is any suitable engine which includes a water cooling system for the engine. Although an engine with a stern drive is shown in FIG. 1 the present invention is also useable on an inboard marine engine.

The present invention is particularly directed to a closed loop cooling system in which a heat exchanger 3 is connected to supply coolant to the marine engine 1 and to the fresh water body to circulate fresh water through the exchanger for cooling the coolant. The exchanger 3 particularly forms the subject matter of the present invention and generally includes a first coolant spiral path defined by a spiral or auger-type baffle unit 4 located within a cylindrical housing 5. A cooling spiral coil 6 is located within the housing 5 and meshes with the spiral baffle unit 4. The coil 6 is connected in series with a water pump 7 for drawing water from the body of water, passing it through the coil 6 as at 8 in FIG. 2 and returning the water to the body. The cooling water effects cooling of the circulating coolant 9 passing through the spiral path defined by the baffle unit 4 in the housing 5. The closed loop system maintains isolation of the engine system from the corrosive water 8 used for cooling.

Figure 2:
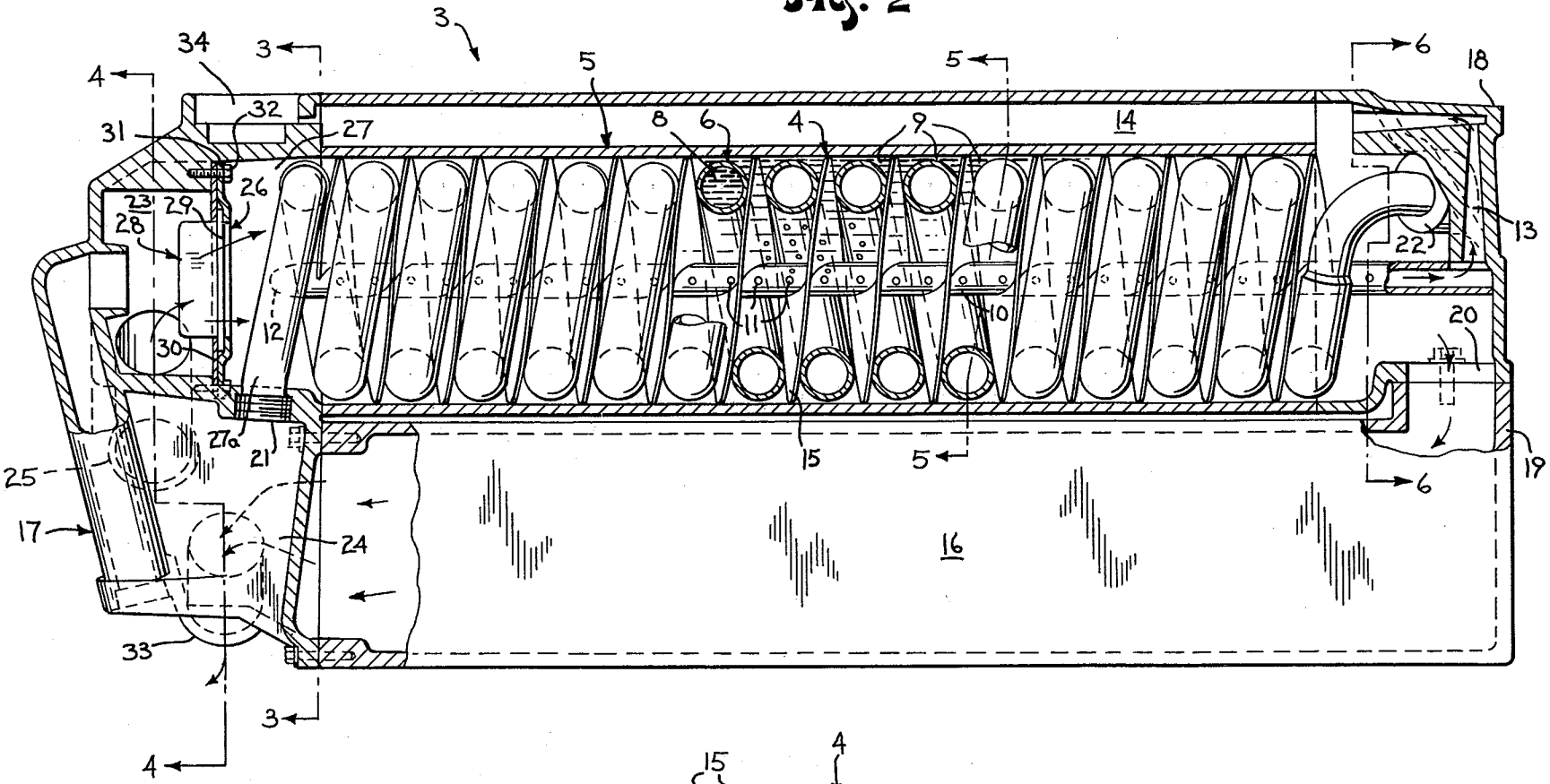
FIG. 2 is an enlarged vertical view of the embodiment of FIG. 1 with parts broken away and sectional to show inner details of construction.
Figure 7:
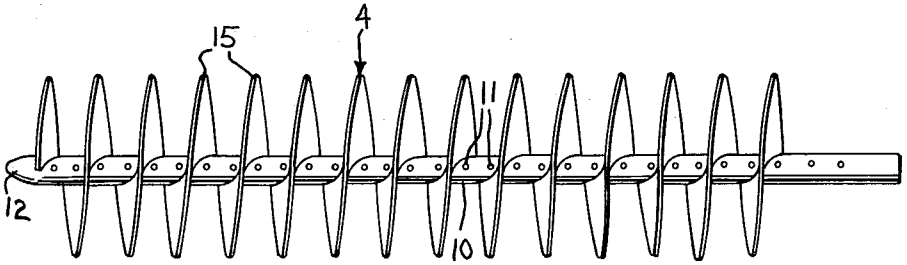
FIG. 7 is a separate pictorial view of the baffle unit shown in FIG. 2.
Figure 4:
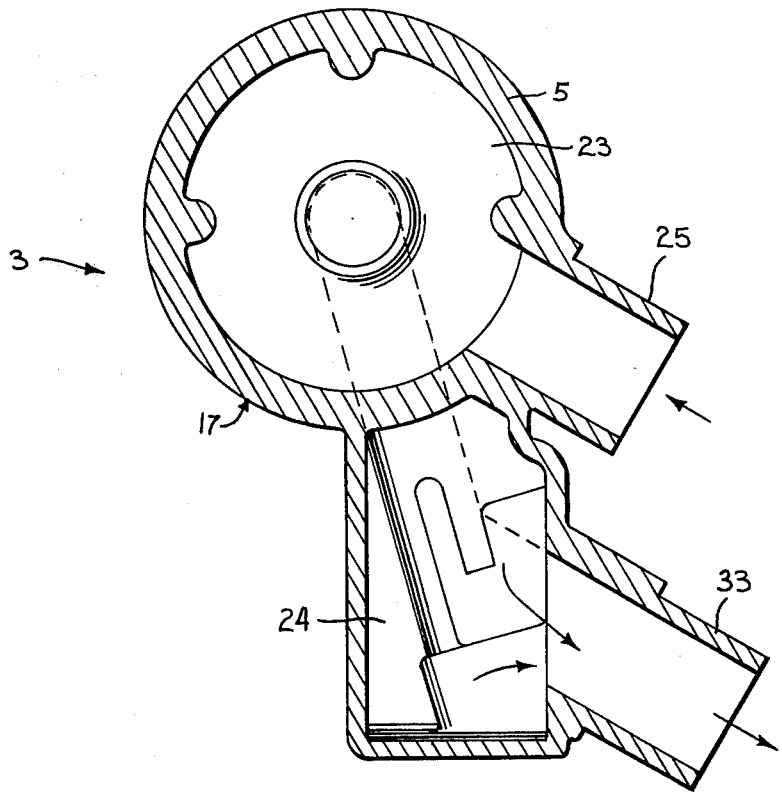
FIG. 4 is a view taken on the broken line 4—4 of FIG. 2 and showing the coolant inlet and outlet connections in one head.
Figure 5:
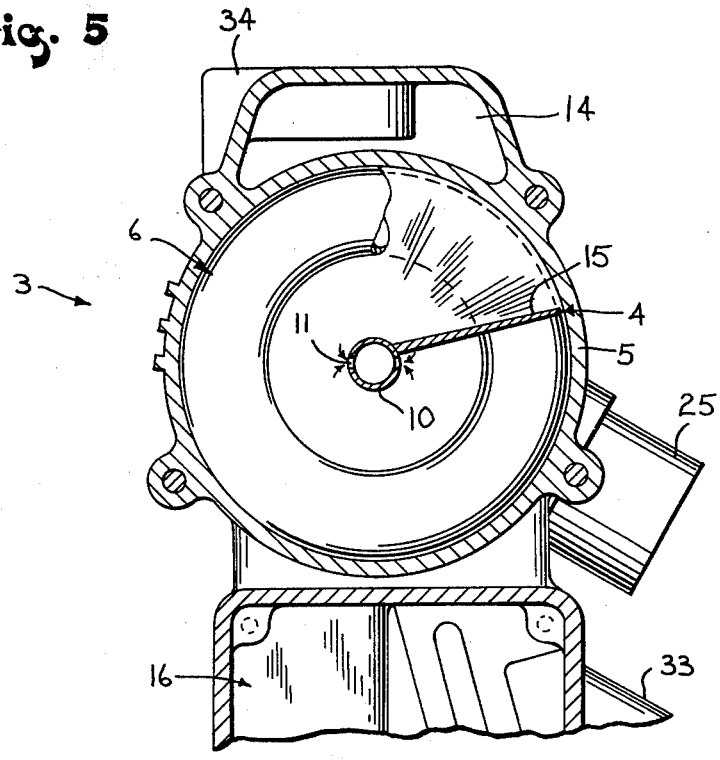
FIG. 5 is a vertical section taken on broken line 5—5 of FIG. 2 and illustrating the coil and baffle relationship shown in FIG. 2.
Figure 6:
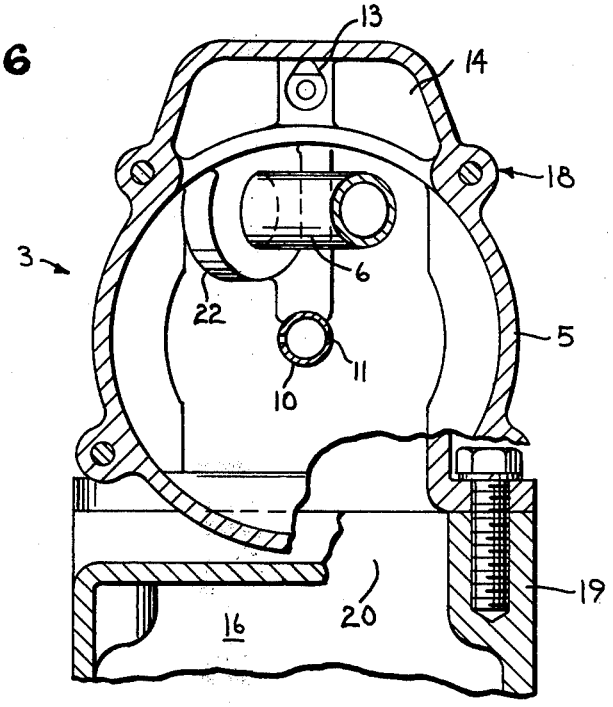
FIG. 6 is a vertical section taken generally on line 6—6 of FIG. 2 and illustrating the air and cooling water discharge paths from one end of the exchanger.

The spiral path of the coolant 9, as defined by the baffle means 4, also causes the coolant to move outwardly to the outer wall of the housing 5 with the separation and movement of air which was carried by the coolant into the center portion of the spiral passageway means. FIG. 2 illustrates an air collecting means or tubular member 10 having a plurality of axially spaced apertures or openings 11 within the center of the housing. One end of the tubular member 10 is closed as at 12 while the opposite end is connected to an air discharge passageway or outlet 13 which terminates in a reservoir 14 at the top of housing 5. The air accumulating within the central portion of the spiral passageway means is withdrawn through the tube and discharged to create a continuous separation of air from the coolant thereby resulting in a significant improvement in the effectiveness of the coolant.

The spiral baffle unit 4 includes a spiral plate or baffle 15 which is secured to the tubular member 10 to define an auger-type structure. The plate member or baffle 15 defines a continuous surface from the tube 10 outwardly to an outer diameter essentially corresponding to the diameter of the housing 5. The plate members 15 may be formed of plastic and closely fit within the housing to define a continuous spiral path for the coolant through housing 5. The housing 5 may be round or rectangular in shape and the baffle 15 of similar corresponding shape.

The spiral tube or coil 6 is formed of a tubing having a diameter corresponding to the spacing between the individual flights of the spiral baffle 4. The coil 6 also has a diameter which is slightly smaller than that of the housing 5 to locate the coil turns adjacent the outer periphery of the baffle 15 and spaced outwardly of the air collecting tube 10. The tubing of coil 6 is formed of material with good thermal conductivity such as copper to provide maximum transfer of heat from the coolant 9 to the cooling water 8. Multiple parallel spiral coils 6 may also be used.

The spiral flow path of the coolant 9 within the baffle 4 and over the spiral tubing of cooling coil 5 provides a highly efficient thermal energy transfer, creates a minimal heat exchange area in which there is no water flow and is less restrictive to flow than prior heat exchangers. The effectiveness of the illustrated air separation means has been shown by the complete purging of air intentionally introduced into the system within a relatively short period.

The heat exchange housing 5 is a generally separate tubular member of round or rectangular shape having an integrally formed reservoir 14. The housing 5 is secured to the upper wall of a manifold exhaust unit 16 and closed at the opposite ends by appropriately constructed closure heads 17 and 18. The exhaust manifold housing 16 is a generally rectangular shaped member with one end provided with an integral closure head 19 underlying and interconnected to the housing 5 through the closure head 18 by a vertical mating opening 20 in the mating housing walls, as shown most clearly in FIG. 2. The opposite end of the manifold chamber 16 is open and the closure head 17 extends across and closes both housing 5 and housing 16 as shown in FIGS. 2 through 5. FIG. 2 is reversed in position from FIG. 1 for more clearly illustrating the flow paths and the connections thereto.

The cooling water 8 is introduced into the spiral tubing 6 through an inlet hose connector 21 in the inlet closure head 17 as shown in FIGS. 1 and 2. The opposite end of the spiral tube 6 terminates in a discharge or outlet hose connector 22 in the opposite end closure head 18. The connectors 21 and 22 are connected to conventional hoses (not shown) which are in turn connected to the pump and discharge means for circulation of water.

The inlet head 17 is also formed with an upper coolant inlet chamber 23 aligned with the one open end of the housing 5 and a discharge chamber 24 aligned with the manifold 16. The chamber 23 has an inlet hose connector 25 for connection to a suitable connecting hose (not shown) to the discharge side of the passageway from the engine 2. The circulation of the coolant 9 is controlled by a thermostatic control valve unit 26 which is mounted within the inlet end of the head 17 to selectively open and close the entrance end of housing 5. In the illustrated embodiment of the invention the head 17 includes a recess 27 for accommodating the initial flight or turn **27*a* of the fresh water cooling tube 6 with the hose connection 21 provided in a bottom wall of the recess. The inner base of the recess provides an annular shoulder. The thermostat unit 26 includes a known generally disc-shaped thermostat 28 having a small annular mounting flange 29 of a diameter less than the diameter of the inlet chamber. A retaining ring 30 and a clamping ring 31 having a diameter essentially corresponding to the base recess and an opening accommodating the thermostat 28 with the flange 29 projecting outwardly between the retaining rings 30 and 31. The rings are secured to the head by a plurality of circumferentially spaced screws 32 which securely mount the thermostat within the inlet chamber. This arrangement provides a substantial flow path with a relatively smooth flow of the coolant over the thermostat 26** thereby providing effective control of the coolant flow.

The coolant 9 flows through the exchanger 3 and is cooled before passing into and through the manifold 16 and discharged into chamber 24 in head 17. The chamber 24 has a hose connector 33 for connecting of chamber 24 to the inlet side of the engine cooling passageway system.

In the illustrated embodiment the housing 5 is shown with the upper reservoir 14 within which the overflow coolant is held to maintain complete filling of the loop system. The one end of reservoir 14 is closed by the head 17. A filling opening 34 for the reservoir and coolant loop is also shown in the end closure head 17. The opposite end of the reservoir 14 is sealed by head 18 with a connecting opening for interchange of coolant 9 in housing 5.

In operation the pump provides for the separate circulation of the fresh cooling water 8 through the spiral coil 6. The coolant 9 flows through the housing 5 and particularly the spiral path defined by the baffle 15 and discharges through the vertical opening 20 in closure head 18 directly into the manifold unit 16 and is discharged from the opposite head 17 through connector 33 for recirculation through the engine block and then back through the connecting hose to the inlet connector 25 in the head 17 for recirculation through the cooling housing 5. As the coolant flows through housing 5 there is efficient thermal transfer of the heat from the coolant to the cooling water. The spirally flowing coolant 9 causes separation of the gases which passes out through tube 10.

Figure 11:
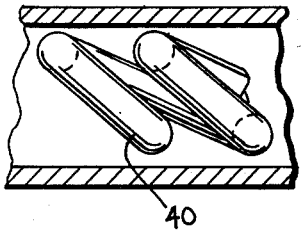
FIG. 11 is a fragmentary view illustrating a further modification of the coil and baffle construction.
Figure 8:
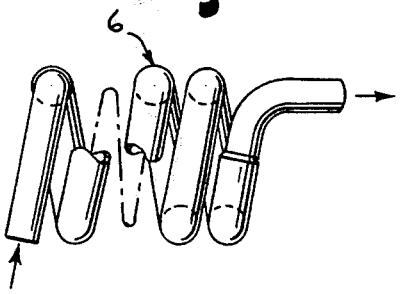
FIG. 8 is a separate elevational view of the coil shown in FIG. 2.
Figure 9:
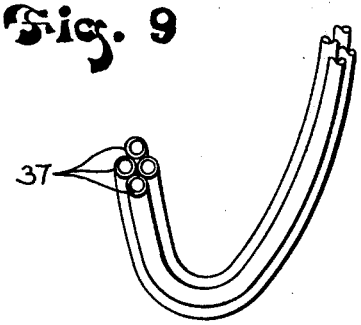
FIG. 9 is a fragmentary view of a coil section showing an alternate embodiment of the invention.
Figure 10:
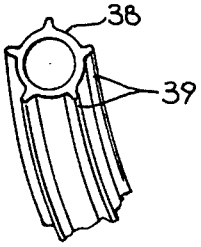
FIG. 10 is a fragmentary view showing still a further alternate embodiment of the coil section for use in the present invention.

The spiral tubing illustrated as a single coil can be made of a plurality of four tubes 37 interconnected to each other as shown in FIG. 9. A plurality of separate and individual spiral related tubes and baffles can also be provided. FIG. 10 illustrates an alternate finned structure and FIG. 11 illustrates bending of the spiral tubing 40 offset or at an angle.

I claim:

1. A cooling system for an internal combustion engine in which a liquid coolant is circulated through the engine, said coolant having entrained gases, comprising a housing means having a spiral flow directing means directing the coolant to flow in a spiral passageway and developing centrifugal forces causing the liquid coolant to move outwardly within said passageway, a gas collection means located generally centrally of the spiral flow directing means for withdrawing said entrained gases from said liquid coolant, and a means located within the radial outer portion of the spiral passageway in radially spaced relation to said gas collection means for cooling the coolant passing through spiral passageway in the housing means.

2. The cooling system of claim 1 including a heat exchange spiral coil located in meshing relationship with said spiral flow directing means for removing of thermal energy from said liquid coolant.

3. The cooling system of claim 1 wherein said flow directing member is a spiral baffle having a central tubular core defining said gas collection conduit means, and having a heat exchange spiral coil meshing with the spiral baffle and located in outwardly spaced relation to the tubular core.

4. The cooling system of claim 3 wherein said housing means is a tubular member, said spiral baffle having an outside periphery essentially corresponding to the inside periphery of the housing means.

5. The cooling system of claim 4 wherein said spiral coil has an outer peripheral dimension slightly less than the outer peripheral dimension of the tubular member.

6. A heat exchanger apparatus for the cooling system of an internal combustion engine in which a liquid coolant including dissolved gases is circulated through the engine, comprising a housing means having a spiral flow directing member for directing the coolant to flow in a spiral passageway, a gas collection conduit means located centrally of said spiral flow directing means, a heat exchange spiral tube means located in meshing relationship within the radially outer portion of said spiral flow passageway in substantial spaced relation to said conduit means and adapted to carrying a cooling liquid for removing of thermal energy from said liquid coolant, whereby said coolant flows through said spiral passageway with the coolant in the outer portion of the spiral passageway in heat exchange relationship to the tube means and with the dissolved gas moving inwardly of the spiral tube means and into the gas collection conduit means.

7. The apparatus of claim 6 including gas collection means located generally centrally of the spiral flow passageway means for withdrawing of gases released from said liquid coolant.

8. The heat exchanger apparatus of claim 6 wherein said flow directing member is a spiral baffle.

9. The apparatus of claim 8 wherein said heat exchange spiral tube means is a closed coil meshing with said spiral baffle.

10. The apparatus of claim 9 wherein said spiral coil includes a plurality of individual adjacent tubes defining parallel flow paths.

11. The apparatus of claim 9 wherein said coil includes heat exchange fins.

12. A water cooling system for an internal combustion engine, a cylindrical housing open at the opposite ends, a spiral flow baffle located in said housing and directing flow in a spiral path and developing centrifugal forces on the liquid causing the liquid to move outwardly, a gas conduit means located generally centrally of the spiral flow directing member for withdrawing of gases released from said flowing liquid, a spiral coil meshing with said baffle and located within the outer peripheral portion of the baffle in radially spaced relation to gas conduit means, an inlet head secured to one end of the housing and having an inlet chamber, a thermostatic valve having a peripheral planar mounting member, a pair of mounting plates adapted to clamp the mounting member therebetween, and attachment means for securing said plates to said head within said inlet chamber to form an end closure wall to the housing with a thermostatically controlled opening.

13. The water cooling system of claim 12, wherein a reservoir is integral with the housing, said gas conduit means terminates within the reservoir for discharging of entrained gases therein.

* * * * *

UNITED STATES PATENT AND TRADEMARK OFFICE

CERTIFICATE OF CORRECTION

PATENT NO. : 4,220,121

DATED : September 2, 1980

INVENTOR(S) : MARIO A. MAGGIORANA

It is certified that error appears in the above-identified patent and that said Letters Patent are hereby corrected as shown below:

| | | |
|---|---|---|
| Column 5, | Line 5, | After "claim 1" cancel "including" and substitute therefore --- wherein said means located with the radial outer portion includes ---; |
| Column 5, | Line 12, | After "and" insert --- said means located within the radial outer portion ---; |

Cancel Claim 7, Column 6, Lines 3, 4, 5 and 6, inclusive;

Column 6, Line 27, After "to" (first occurrence) insert -- said --.

On the title page after the abstract, "13 Claims" should read -- 12 Claims -- .

Signed and Sealed this

Third Day of February 1981

[SEAL]

Attest:

RENE D. TEGTMEYER

Attesting Officer

Acting Commissioner of Patents and Trademarks